United States Patent [19]

May

[11] Patent Number: 4,728,282

[45] Date of Patent: Mar. 1, 1988

[54] METHOD AND APPARATUS FOR CONDUCTING A SUBSTANTIALLY ISOTHERMAL COMBUSTION PROCESS IN A COMBUSTOR

[75] Inventor: Michael G. May, Bel Air, Switzerland

[73] Assignee: Air, Ltd., Arlington, Va.

[21] Appl. No.: 862,356

[22] PCT Filed: Sep. 12, 1985

[86] PCT No.: PCT/US85/01730

§ 371 Date: Jun. 23, 1986

§ 102(e) Date: Jun. 23, 1986

[87] PCT Pub. No.: WO86/01876

PCT Pub. Date: Mar. 27, 1986

[51] Int. Cl.[4] ..... F23M 3/00

[52] U.S. Cl. ..... 431/9; 431/37; 431/115; 431/75

[58] Field of Search ..... 431/5, 9, 20, 37, 75, 431/115, 116, 173, 352

[56] References Cited

U.S. PATENT DOCUMENTS

| | | | |
|---|---|---|---|
| 1,609,150 | 11/1926 | Breese | 431/115 |
| 1,896,910 | 2/1933 | Merkt | 431/115 |
| 2,927,632 | 3/1960 | Fraser | 431/352 |
| 2,959,215 | 11/1960 | Warnecke | 431/116 |
| 3,146,821 | 9/1964 | Wuetig | 431/115 |
| 3,741,166 | 6/1973 | Bailey | 431/9 |
| 4,427,362 | 1/1984 | Dykema | 431/352 |
| 4,588,375 | 5/1986 | Sandstrom | 431/115 |

FOREIGN PATENT DOCUMENTS

| | | | |
|---|---|---|---|
| 2059693 | 6/1972 | Fed. Rep. of Germany | 431/116 |
| 2365186 | 7/1975 | Fed. Rep. of Germany | 431/9 |
| 2603988 | 8/1976 | Fed. Rep. of Germany | 431/115 |
| 3048201 | 7/1982 | Fed. Rep. of Germany | 431/116 |

*Primary Examiner*—Carroll B. Dority, Jr.
*Attorney, Agent, or Firm*—Edwin E. Greigg

[57] ABSTRACT

The invention is directed to improvements in furnaces. A method and apparatus for conducting a substantially isothermal combustion process in a combustor 2 is disclosed in which three methods are employed and two of the methods separately or in combination, namely, (1) controlled radiation in the vicinity of flame emission within the combustor, (2) temperature-responsive controlled flowrate increase of recirculation of exhausted gases including recirculated heat and water vapor into the primary combustion zone, and (3) controlled staged oxidation of and heat extraction from each of a plurality of oxidation or combustion zones, which methods are performed by means of, respectively, a radiation shield means 40 for guiding the flame of combustion, a variable orifice means in the primary air-supply 24 to the primary combustion zone, and a bypass means 42 from the air supply to respective combustion zones within the combustor, each of which has associated therewith a heat extraction means 46, so that not only is combustion efficiency in the combustor increased but unwanted pollutants are radically reduced in the exhaust gas of the combustor.

16 Claims, 13 Drawing Figures

METHOD AND APPARATUS FOR CONDUCTING A SUBSTANTIALLY ISOTHERMAL COMBUSTION PROCESS IN A COMBUSTOR

TECHNICAL FIELD

The present invention is related to furnaces, combustors, heat generators and the like, in which a normally exothermal combustion process is evidenced and in which it is desirable to lower the emission of pollutants into the atmosphere and at the same time improve the combustion process in such combustors.

BACKGROUND ART

In one of the most recent and complete descriptions of the state of the art, in U.S. Pat. No. 4,427,362 it is stated that the essentially impossibility to achieve complete combustion combined with low NOx emissions except with a rather sophisticated high temperature multistage combustion process. Particularly low NOx emission levels are claimed not be achievable in "the initial combustion" (Col. 6, lines 65). Therefore it is stated necessary to have at least two oxidation stages, respectively multi zone or staged combustion.

These arrangements are expensive in many respects and do not provide easy retrofit potential in existing boilers, firing spaces inside existing boilers for example.

It is therefore a purpose of the present invention to dramatically reduce pollutants with simple means already and predominantly in the initial or first combustion stage. Other stages and combinations may be added.

The invention has particular application to methods and devices for reducing unwanted emissions, such as CO, HC, $NO_x$ and soot (carbon monoxide, hydro-carbons, nitrogen oxides and soot) in stationary furnaces and the like which use the assistance of air along with the fuel supply and at least one burning zone within the combustor, wherein the fuel may be liquid petroleum gas (LPG), or other burnable gases, fossil fuels, such as oil or coal and coal-based products or combinations thereof.

In the past such reduction of unwanted emissions have been done by recirculation of exhaust gases, by multi-stage combustion using additional burner assemblies, by flame division through the use of flame stabilizers by fuel conversion, and by catalysts used in the combustion process. These processes often involve great expense by necessitating the addition of expensive equipment to the furnace or combustor in which they are to be used. Further, such methods have often been used without the aid of a proper analysis of their effects on combustion, and so while eventually reducing unwanted pollutants they have sometime sacrificed combustion efficiency during the combustion process. Most of the proposed solutions have proved to have had such severe drawbacks that they could not realize their intended results and have thus far defined only a paper state of the art. A need therefore exists in which both high combustion efficiency and reduction of unwanted emissions can be achieved.

DISCLOSURE OF INVENTION

It is a primary object and purpose of the present invention to improve the combustion process in a combustor which otherwise operates in an exothermal manner, while at the same time radically reducing unwanted emissions from such combustion processes, such as hydrocarbons, nitrogen oxides, and the like. Accordingly, it is a purpose and object of the present invention to approximate a substantially isothermal combustion process for burning combustible products in a combustor. Thus, the invention has for its ancilliary purposes and benefits to provide a cost effective and reliable radiation shielding and EGR structure for realizing the method according to the invention, which structure allows a "retrofit" installation and inexpensive conversion of an already installed conventional burner in a combustor, particularly the so-called single stage burner in which the improvements obtained with respect to the combustion quality and emission reduction are unexpectedly high.

The present invention permits, for example, an over 80% reduced $NO_x$ content in the raw exhaust gases of a combustor, wherein during test and evaluation runs of a burner fitted by the means of the present invention these exhaust gases contained $NO_x$ concentrations below 10 ppm at HC levels below the ambient air emission values which heretofore has been unknown, and which results are in large measure the consequence of the invention's method for realizing a substantially isothermal oxidation process during the course of combustion in the furnace combustor.

It is well known that the rate of heat release generated respectively by a charge particle, that is, a combustible particle undergoing a combustion process is closely related to its actual temperature and the availability of oxygen. The exponential rise of the heat release at the beginning of the combustion process, and subsequent decline, once a predominant part of the oxygen has been consumed, is a well known phenomenon. In essentially continuously burning conditions, a furnace, for example, a quantum charge is considered to undergo the combustion process within a finite time span, and it is within this finite time span that the method according to the present invention has its particular application which allows for complete combustion even with minimal oxygen excess to achieve complete combustion. Because of the low amount of excessive air required for complete combustion according to the invention, efficiencies of near 99% at corresponding values of $CO_2$ concentration around 13% volume are possible with LPG.

In accordance with the principles of the invention, three methods are employed for realizing the principle method as above described. These methods may be employed separately, save for one of the methods, or in combination, depending on the degree of efficiency of combustion desired as well as the degree of reduction of emissions desired and depending upon the geometry and the purpose of the particular furnace used with the invention.

More particularly, the present invention proposes increasing or enhancing the rate of heat release, (ROHR) of the combustible products in a combustion process until the temperature of those products reach a lower temperature limit beneath which certain components of the combustible products are not ordinarily caused to be self-ignited, and subsequently impeding the ROHR of the combustible products above a temperature limit which is not below the aforementioned lower temperature limit so that the combustion process is caused to follow a substantially isothermal behavior pattern. By impeding the ROHR, a longer duration of the total heat release is effected because the combustion flame is kept at lower temperatures, which in turn affects the ROHR, as is well known in combustion theory.

The first (1) method contemplates the use of radiation theory and technology, that is, controlled radiation for realizing substantially isothermal oxidation in the combustion process. The second (2) method according to the invention provides for a controlled increase of a high flowrate of recirculated heat and water vapor out of the once combusted gases leaving the combustion zone back into the fresh charge for thus approximating isothermal combustion. And the third (3) method according to the invention, if used in combination with the other two methods, provides for controlled staged oxidation and heat extraction in at least two distinct oxidation zones in combination with correspondingly distinct heat release and heat transfer zones in order to achieve substantially isothermal combustion within the combustor.

As already mentioned the above methods may be employed singly, save for the third method, or in combination so that in effect six different approaches are possible for achieving the aforementioned results; for example, if the methods are identified as 1, 2 and 3, above, then two of these comprise individual approaches; methods 1 and 2, 1 and 3, and 2 and 3, comprise three more approaches, and 1 and 2 and 3 comprise the sixth approach.

In accordance with the principles of the invention the first method above referred to, namely, the method of controlled and predetermined radiation, the flame generated by combustion is caused to impinge upon a radiation shield means, preferrably of low thermal inertia, which has for its purpose to reduce the travel time of a particle of the charge traversing the zone of the thus controlled combustion. Thus a short travel time of the burning particle of charge is effected by the flames of combustion impinging on the shield means early in the guided combustion process, by which impingement heat is absorbed by the shield means thus further impeding the attainment of higher temperatures of the particles.

Under normal operating conditions the shield means absorbs the peak temperatures of the flame composed of these burning particles thereby causing impedement of ROHR. This absorbed heat is transformed into radiation in the shield by its material characteristics, especially by its radiation behavior which depends on the degree of emission of the shield material. The radiation, therefore, limits the upper temperature of the shield while at the same time radiating not only towards the heat transfer means to be heated outside of the shield but also in the opposite direction towards the combustion zone and into the zone ahead of the combustion zone where prereactions already take place thus enhancing these prereactions and therefore the ROHR therein essential for an earlier and faster rise of heat release and heat generation already in the pre-reactions zone.

The dimensioning, profiling and shaping of the shield surface as well as its material composition are chosen such that the travel time of charge particles through the flame before they impinge upon the shield are preferably shorter than 1/100th second, and, depending upon the shield means design, can range from 2 to 10 milliseconds. Thus, the design criteria of the shield and its relative position with respect to the flame initiation location and/or combustion zone, together with the nomimal gas velocities and velocities of the charge particles, will determine the travel time of these charge particles. The radiation R exhibited by the shield means is proportional to the temperature $T^4$, as is well known from the equation. $\Phi=\epsilon\sigma AT^4$ $\Phi$=heat flow in W (Watt)

$\epsilon$=emissivity of the surface $\sigma$=radition constant of a black body ($5.67\times10^{-8}$ $W/m^2K^4$)

A=surface in $m^2$

T=temperature in °K. (Kelvin)

According to this law, a load change of the burner will result in only small variations of the temperature of the radiating shield means. Furthermore, as the massflow and the related heat flow changes in relation to load changes, the surface of the shield being impinged by the concomitant changing flame path also changes so that even a further narrowed temperature change over the burner load change is realized. It is therefore possible to maintain a desired temperature of the shield means within surprisingly narrow limits in spite of comparatively large variations of the load output of the burner and/or the furnace. These design criteria of the shield can be chosen such that under normal operating conditions a desired upper temperature limit in the shield means can be realized, while for a minimum load for the furnace, a minimum temperature of about 650° Celcius can be achieved. The desired upper temperature of the shield determining substantially the upper temperature of the combustion process can be considered merely as a threshold for the upper temperature. The flame, upon impingement, follows essentially the flow of the gas stream, which would be established also without a flame by at least the air flow utilized for the combustion process, the flow pattern being predominantly caused by the shield means, as schematically shown in the subsequently following figures. Thus, a comparatively large surface is guiding the flame on a comparatively long (guided) flame path along the shield surface, so that an unwanted high ROHR is impeded along essentially the entire flame length.

The upper temperature limit therefore can now be predetermined by applying the equation above for the criteria, for a predetermined upper temperature limit is mainly dictated by the application of the furnace. As an example, for domestic purposes, an upper temperature of 750° C. may well be sufficient, whereas for steam generation the limit may be chosen for instance to be about 950° C. It must be emphasized that the heat transfer to the medium to be heated is in these cases, according to the inventive method, essentially carried out by radiation of the shield, and therefore the inventive radiation shield technique applies.

This relationship between radiation and temperature as well as the the short travel time of charge particles before impinging on the shield allows one to effectively conduct the combustion process within a predeterminable and relatively narrow temperature band, thereby avoiding unwanted peak temperatures of the charge or combustible products. Consequently, the pollutant formation of the combustion process is not only dampened or impeded but is controllable.

Furthermore, the radiation exhibited by the shield means obviously radiates back into the combustion zone as well as away from it, given that the shield means will be defined by at least two surface areas facing, respectively, towards and away from combustion. Under these circumstances a pre-combustion zone as well as a post-combustion zone will be affected by the radiation from the shield means, according to the invention. Thus, the so-called back radiation into the pre-combustion zones will assist the pre-reactions, namely hydrocracking, hydroforming and formation of various radicals, such as oxhydryls and hydroxhyls, and other known pre-combustion products, particularly in the case of water vapor introduction into the fresh unburnt charge and therefore will enhance heat release of the charge in the early stages of combustion. In this way by means of early enhancement and subsequent impediment of ROHR of the combustible products in a combustion process a substantially isothermal combustion process can be conducted and controlled, thereby minimizing pollutants and maximizing combustion efficiency.

The second method as above described, namely, combustor-temperature related recirculation of large but controlled flowrates of hot water vapor, preferably at overcritical temperatures, and inert gases from the completed combustion process back into the air-fuel mixing zone, preferably into the air supply conduit where high air velocities entrain and mix the EG with the air, is yet another method for achieving a substantially isothermal combustion process. This comparatively large amount of recirculation of the above mentioned exhaust gas (EG) products acts upon the fresh charge thereby increasing dramatically the temperature rise of this charge and hence speed up formation and establishment of exothermal reactions for enhancing the rate of heat release (ROHR). The preferred carrier for the heat and water transfer from the burnt combustible products to the fresh charge to be burnt are the burnt gases themselves since they directly contain the water and the heat aimed for. If, for instance, a flow rate of about 50% volume or more of exhaust gas recirculation (EGR) is implemented this mass flow will upon introduction into the fresh charge release heat to the fresh charge, and when the combustion of the charge takes place, absorb heat to such a large extent as to significantly reduce unwanted peak temperature that would otherwise occur in the normal combustion process without EGR. For example, a 50% EGR will reduce close to 50% of the peak temperature that would be otherwise present. Combustion, therefore, starts at a higher temperature and reaches lower peak temperatures, thus again demonstrating that a substantially isothermal combustion can be achieved in comparison to the conventional exothermal combustion exhibited by conventional combustors.

Also, and particularly with heavy fuel and also in coal furnaces, the large hydrocarbon molecules break down during combustion, and the water vapor content of the recirculated part of the exhaust gases assist in this "cracking" process by means of an "in- stitu" reforming process. Thus, generation of radicals, oxhydryls and hydroxhyls is enhanced by the presence of $H_2O$ in an overcritical form, due to its high temperatures, and therefore favorably promotes clean combustion.

According to the invention, the EGR flowrate is controlled in response to a temperature which is a function of the temperature generated by the combustor or furnace. It should be understood that under start-up conditions and under low load operations, a conventional burner using the high EGR rate taught by the present invention without the combustor temperature related flow control would not ignite and would, therefore, be subject to blow-out even if it were possibly started. Further, according to the invention, EGR is applied in such a way as to at least partially pre-mix a controlled amount of combusted gases with at least a part of the air intended for the oxidation process preferably prior to a first combustion zone.

By applying the method herein described the EGR flowrate is kept at a minimum during start up and warm up operation, and only after a predetermined temperature level is approximately achieved is the desirable EGR flowrate established. The method for flowrate control of EGR accordingly contemplates the use of a flowrate control means which is temperature responsive, as previously mentioned.

In the case, where the radiation shield means closely controls and thereby stabilizes the flame path and its upper and lower temperatures, extraordinary high EGR flowrates of above 70% could be realized while still maintaining an absolutely stable flame, and thus realizing a surprisingly near to isothermal combustion process. Such high recirculation rates up to now have been considered impossible to achieve.

In the third method according to the invention above described, namely, controlled partial oxidation and heat extraction in at least two consecutive oxidation and heat exchanging zones, a fuel-rich mixture of a burnable charge is supplied to a mixing zone, wherein preferably a part of the recirculated exhaust gases may be present. Since oxidation cannot be completed in and following the first mixing and combustion zones, heat generation is correspondingly reduced, thereby reducing peak temperature with correspondingly reduced thermal $NO_x$ formation. Due to missing oxygen, a reducing condition remains thus keeping chemical $NO_x$ formation at low levels, as is well known per se. A part of the heat generated, preferably an essential part, is then transferred from the first combustion zone to the medium to be heated so as to bring the temperature level of the burning charge towards a reference value, which instead of a temperature of approximately 2000° C. in conventional burners, may be preferably in the range of 700° C. to 1000° C. in order to remain well above self-igniting temperatures of the yet unburnt and partially oxidized hyrocarbons and fuel material to be burnt. An amount of oxygen containing gas, air for example, is then introduced into at least one of the next or subsequent stages of combustion or combustion zones within the combustor in order that the complete oxidation of the burnable material will be accomplished with a corresponding heat release. By means of this last method an enhancement of ROHR is also achieved because the first fuel-rich zone reaches earlier higher temperatures due to lesser amounts of air to be preheated since portions of that air are bypassed to subsequent combustion zones. Further, the staged combustion according to this particular method of the invention splits or divides up the heat release, and since heat is extracted after or at each stage of combustion, peak temperatures are avoided and heat release is much slower. Thus, a flatter temperature curve is realized in which ROHR is smaller than what could be realized by ordinary single stage combustion. Again, by enhancing ROHR in the pre-reaction zone and subsequently impeding ROHR in the combustion zones a substantially isothermally behaving combustion process is realized.

The invention will be better understood and further objects and advantages thereof will become more apparent from the ensuing detailed description of the perferred embodiments taken in conjunction with the drawings.

BEST MODE FOR CARRYING OUT THE INVENTION

It is well known that heat released by a charge element undergoing a combustion process is closely related to its actual temperature and the availability of oxygen. Therefore, the exponential rise at the beginning of the combustion process of heat release and its leveling off, once a predominent part of the oxygen has been consumed thus reducing its availability, is well known. In an essentially continuously burning combustor, a quantum of charge, therefore, is considered to undergo a combustion process requiring a finite time. This heat release is generally shown upon a time basis and is represented in percentages of the theoretical heat to be released by the fuel.

Figure 1:
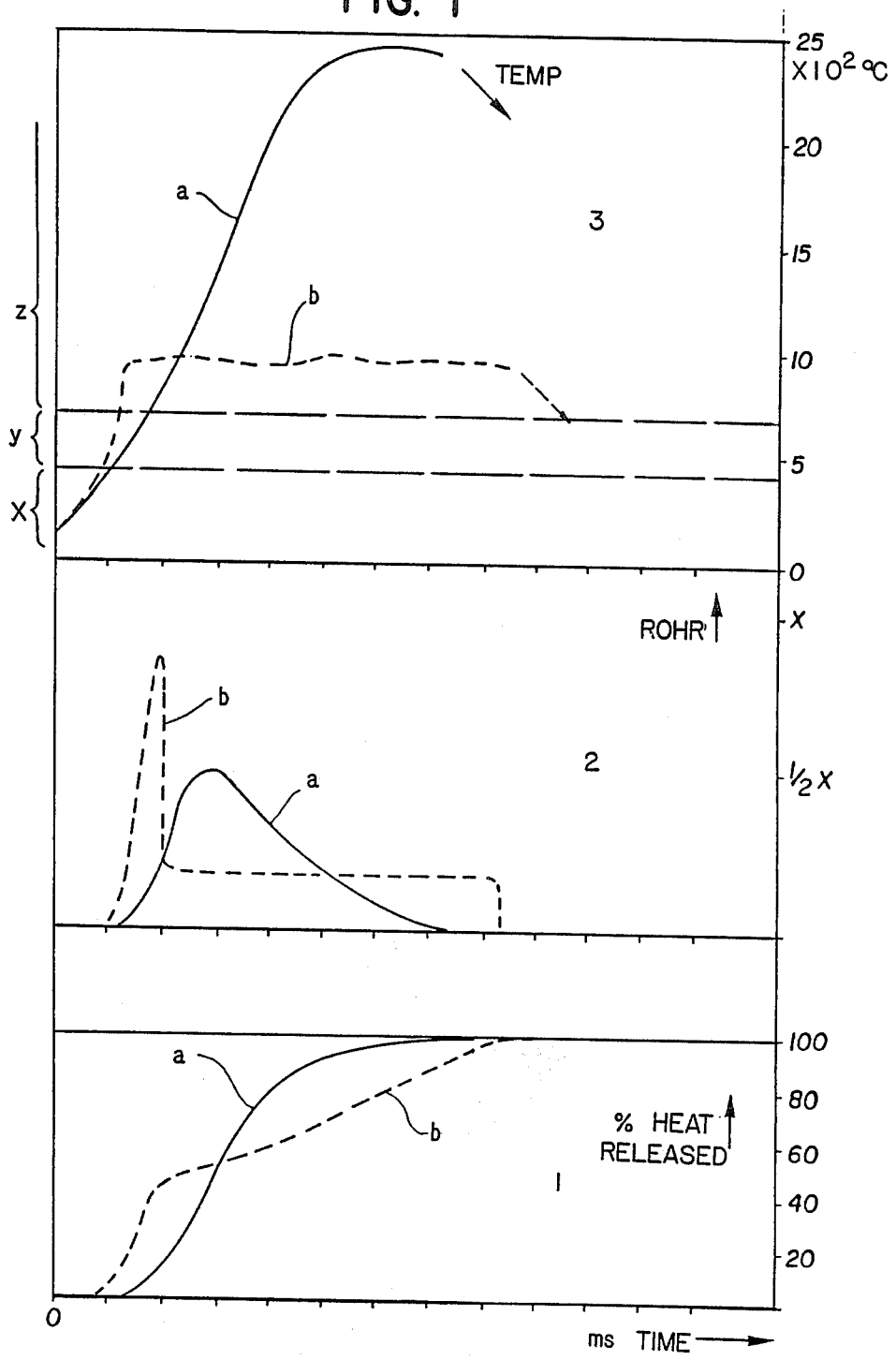
FIG. 1 is a schematic graph diagram illustrating the principles of the invention with respect to combustion temperature.

Referring now to FIG. 1, there is shown a graph in three stages illustrating, from the bottom up, a conventional exothermal combustion shown in solid lines versus the near or substantial isothermal combustion process according to the invention, shown in dotted lines. In the bottom most part of the graph (1) the two combustion processes are plotted in terms of percentages of heat released over time as described above. It will be seen that for a conventional combustion process in a combustor not employing the methods according to the invention, the curve a shows an exponential rise in heat release by the combustible products during the course of combustion and then a gradual falling off until 100% heat release is reached. The heat release exhibited by the combustion process using the principles of the invention, on the other hand, shows via the curve b a marked increase in heat release in the earlier stages of combustion and a significant impediment of the heat release until 100% is reached. In the next graph marked (2) the rate of heat release (ROHR) is plotted, wherein curve a is seen to exhibit a generally sinuous curve having a peak bordered by two peripheral lows, while curve b shows a marked rate of increase and then a sudden drop to almost no rate of increase and a substantially constant or isothermal heat release during the combustion process. In the third graph (3) the substantially isothermal behavior of the combustion process according to the invention, as indicated by the curve b, is in marked contrast to the normally exothermal nature of a conventional combustion process, that is, curve a. On the left side of the diagram the combustion temperatures are divided into three zones: (x) a warming up or pre-heat zone, (y) a pre-reactions zone in which a "cool flame" may be detected, and (z) a normal or true combustion zone in which a hot flame is manifest. It will be seen that the rise in temperature in the warming up and pre-reaction zones is quicker for curve b than it is for curve a, and that once the beginning stages of the normal combustion zone are reached the temperature for combustion are severely impeded such as to reflect a substantially isothermal reaction or combustion while the burnable or combustible particles are resident in the combustor. Curve a, on the other hand, shows an ever increasing rise in temperature during the course of combustion while the combustible materials are resident in the combustor. By impeding the ROHR, a longer duration of the total heat release, as shown in FIG. 1, is effected because the flame is kept at lower temperatures, which in turn affects the ROHR, as is well known.

Figure 2:
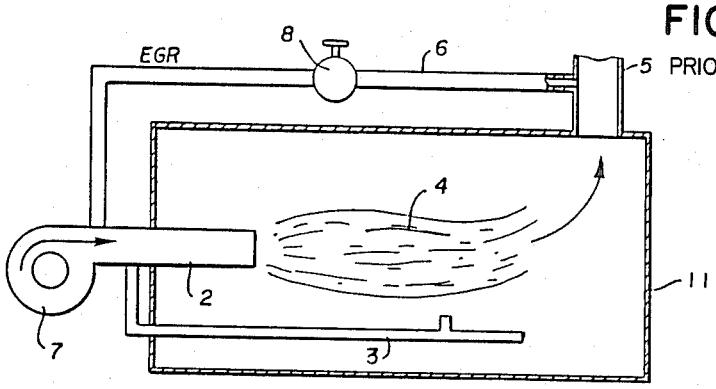
FIG. 2 PRIOR ART
FIG. 2 is a schematic illustration of a prior art method of EGR used in combustors.

In FIG. 2 there is shown a prior art device in which a furnace 11 contains an air/fuel conduit 2 which may be provided with an air-bypass 3 for staged combustion downstream of the flame path. A flame 4 is shown issuing toward the stack 5 from which combusted gases are recirculated via the conduit 6 to the primary air supply 7 for either single combustion or staged combustion. A valve 8 in conduit 6 may or may not be supplied for calibrating or setting the EGR mas flow.

Figure 3:
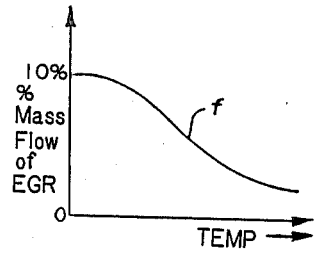
FIG. 3 PRIOR ART
FIG. 3 is a schematic illustration of a prior art EGR mass flow rate in combustors.

In FIG. 3 is shown a schematic graph illustrating the mass flow of EGR in the prior art device shown in FIG. 2 in which the mass flow is shown to decrease with temperature increase in an uncontrolled EGR from the stack 5.

Up to now, the EGR flow rates have been essentially uncontrolled thus preventing thorough application of EGR in furnaces because at start up and part load operation of a conventional EGR, the mass flow is high and decreases when temperatures are high in such combustors equipped with such conventional EGR.

Figure 4:
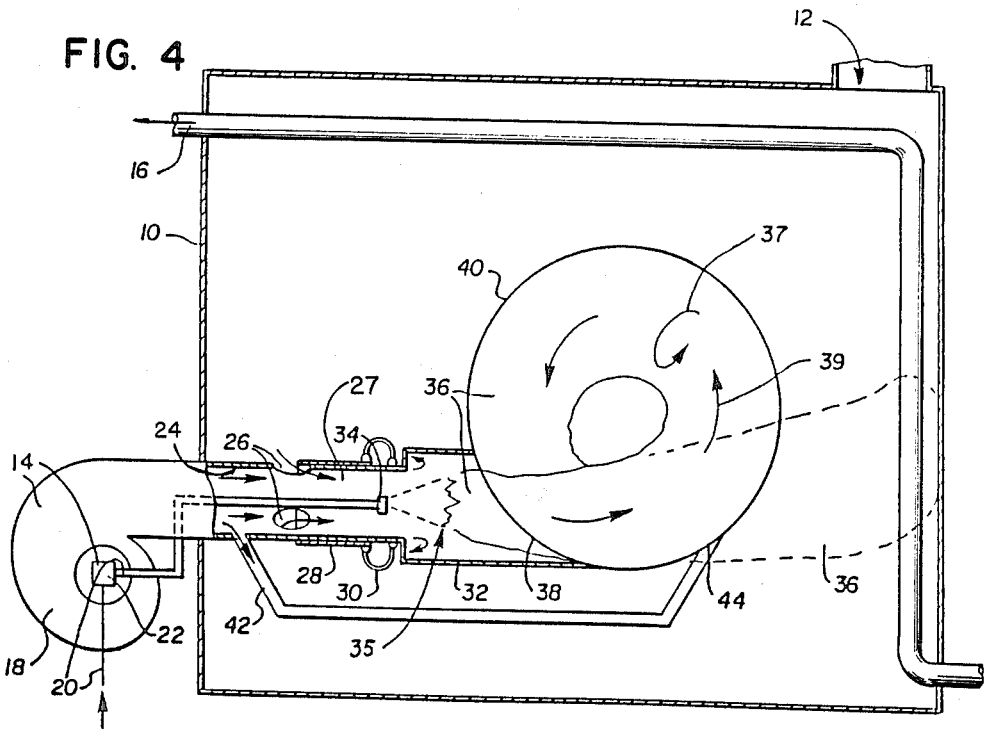
FIG. 4 is a schematic elevational view partly in cross section illustrating a burner assembly employing a radiation shield apparatus embodied by the method of the invention.
Figure 5:
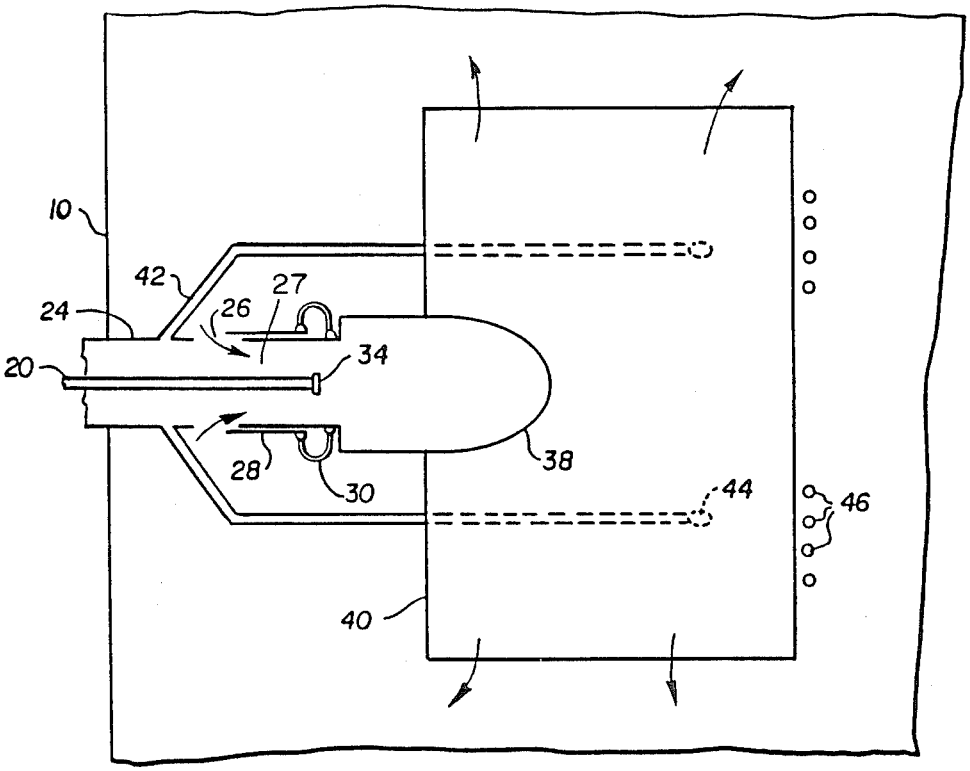
FIG. 5 is a schematic plan view partly in cross section of the invention shown in FIG. 4.

Referring now to FIGS. 4 and 5, there is shown an apparatus for realizing the three methods according to the principles of the invention, namely (1) controlled radiation within the combustor, (2) a temperature controlled high flow rate of recirculated heat and water vapor of the at least one zone of combusted gases, and (3) controlled staged oxidation and heat extraction.

A furnace 10, which may be a stationary furnace, is shown having an exhaust 12 and a fuel-air input 14 and a heat transfer medium 16, that is, a medium to be heated by the furnace.

The fuel-air input comprises a conventional blower 18 and fuel supply 20 having a fuel-air mixture control 22 of known design. The blower conduit 24 has EGR orifices 26, one of which is shown, spaced circumferentially around its periphery, and a surrounding tube member 28 is seen to surround the conduit 24 with its edge portion in the vicinity of the orifices 26. The other end of the tube 28 is slideably connected via a temperature-responsive bi-metallic expansible member 30 to an enlarged conduit section 32 so that the tube 28 can vary the opening of the EGR orifices 26 in response to temperature in the combustor. Thus with increased temperatures the EGR orifices are increasingly opened to thereby increase EGR. The EGR is caused to enter the orifice 26 and hence into the EGR and air mixing zone 27 by virtue of the pressure differential created by the flow of air within the conduit 24.

Alternatively the EG may be recirculated back to the primary combustion zone by known means, such as by an injector pump or fluid entrainment pump of known design. In such cases, of course, control of the EGR would be temperature dependent that is, dependent on the temperature in the furnace, as previously described, so that what is effected is a positive closed loop control of EGR flow rate in response to a temperature related input signal to the control device.

Where the larger conduit 32 takes over from the smaller conduit 24 there is positioned a fuel nozzle 34, and the area just in front of the nozzle 34 is a mixing area 35 for the air and fuel to combine, enter into combustion zone and thus generate a flame 36. The flame 36 under normal conditions would extend in a forward direction from the fuel nozzle as shown in dotted lines, but in accordance with the principles of the invention the flame 36 is caused to impinge on a radiating shield member 40 which is in the form of a generally shaped drum member that communicates with conduit 32 via the orifice 38. Impingement occurs early in the combustion process and not at the end or near the end of the flame, thus effecting shorter travel time of the charge particles, as previously described. While a drum shaped shield is shown here for convenience, it should be understood that the shield member 40 can be shaped to different geometries, depending on the heat requirements of the furnace in which it is used as well as the degree of temperature impediment desired for the combustion process, as, for example, the axial-type of shield 40' shown in FIG. 5*a*, in which similar parts to those shown in FIG. 4 are similarly numbered. As further shown in FIG. 5*a*, the burner is axially baffled by a baffle member 41, so as to cause an initially essentially radial flame as shown on shield 40'. In any case the shield essentially envelops or covers the flame or flame path.

The flame 36 is essentially developing at the orifice 38 and impinges upon the inside surface of the shield 40, thus following the circular path in a swirling and axially extending direction, as best shown in FIG. 5. The flame in this case is split into two oppositely extending paths along the axis of the drum shaped shield so that the flame 36 will eventually be dissipated along the inner surface of the shield towards both exit ends. The incurved flow path of the burning mass induces secondary flow patterns 37, generally perpendicular to the primary flow direction 39, as is well know, thus enhancing impingement of flame elements (charge units or particles) on the shield.

Additionally, there is provided air supply conduits 42 to the shield member 40 from the air supply conduit 24, which conduits 42 exit via orifices 44 located at the bottom of the shield, as shown. The location of the orifices 44 coincide with what would be secondary zones of combustion on either side of the primary zone of combustion. For this purpose it is conceivable within the precepts of the invention that additional conduits 42 could be extended from the supply conduit 24 to thereby supply air to additional combustion zones along the axis of the drum shield 42. Further, each additional combustion zone may have the presence of heat extraction pipes 46 for extracting heat from each combustion zone or otherwise radiation around the secondary zones dissipate the heat generated in these zones.

In operation the invention as embodied by the apparatus shown in FIGS. 4, 5 and 5*a* functions as follows: Fuel, LPG for example, is adjustably metered by control means 22 and travels through the conduit 20 and thus out the nozzle 34 into the mixing area within the conduit 32 where it mixes with the air supplied by the blower 18 through the conduit 24. The final fuel air ratio may be controlled by the adjustable mixture control valve 22. When the furnace is cold the orifices 26 are closed which does not permit EGR flow into the airstream. When the mixture is ignited by a suitable means a flame is generated which travels through the orifice 38 and swirls around the inner periphery of the shield 40 so that the shield 40 radiates heat both inwardly towards the combustion zones and outwardly to the heat transfer medium 16. In the process of traversing the inner periphery of the shield 40, the flame 36, in this particular embodiment, assumes the general shape of a helix and spreads outwardly in opposite directions from the source of the flame, namely, the orifice 38.

Figure 6:
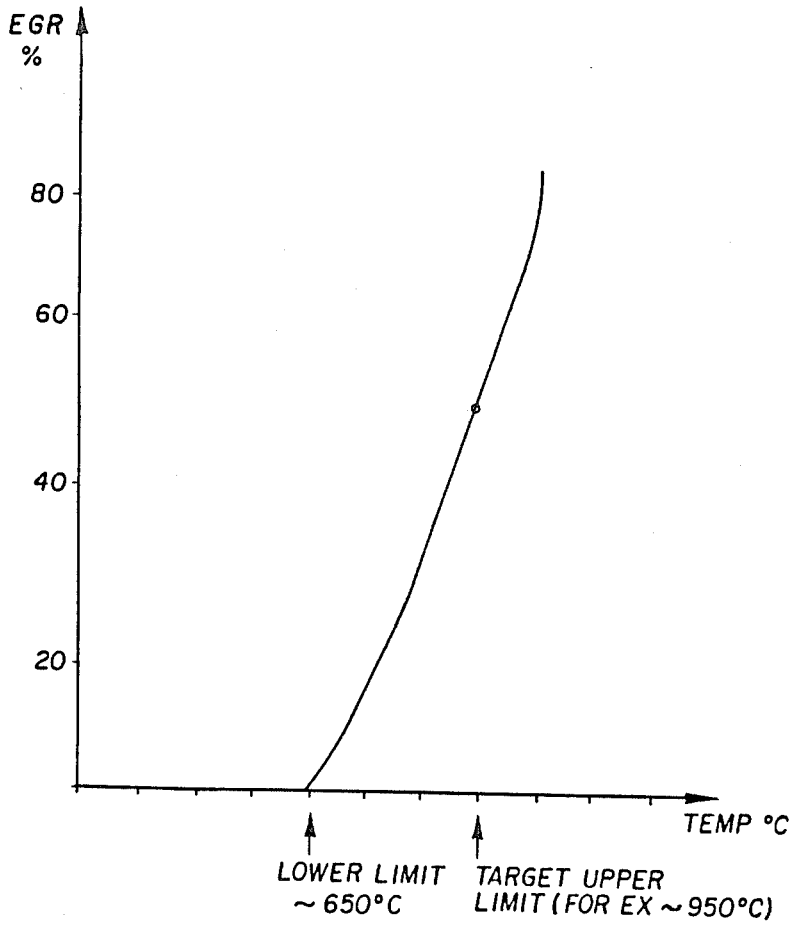
FIG. 6 is a schematic illustration of the EGR mass flow rate in the combustion according to the invention.

Once the warm-up phase of the combustion process has been completed, recirculation of EGR begins with opening of orifices 26 by means of the temperature responsive sheath member 28, as shown in FIG. 6. By contrast, the line f in FIG. 3 shows a conventional constant decrease in EGR flow afforded by conventional combustors, such as shown in FIG. 2, which does not provide a selectable EGR flow rate as a function of temperature related control parameters. According to the invention, a further increase in temperatures above about 650° C., for example, increases the EGR flow rate so that about 30% or more of EGR is recirculated into the primary combustion zone which then serves to impede the ROHR of the combustible products, as previously explained.

In FIG. 6 the mass flow rate increase of EGR is shown schematically as a sharp rise once the lower temperature level is reached. Since the flow rate further increases also above the targeted or desired upper temperature value, the temperature controlling, stabilizing effect of the large recirculation impedes such overshooting of the aimed-for upper temperature. Thus, the positive, closed-loop control of EGR flow rate in response to temperature of the combustion process avoids start-up, warm-up, and blow-out phenomena while still establishing a very high EGR flow rate at nominal and high loads of the combustor, and efficiently maintains, therefore, a substantially isothermal combustion process.

The conduits 42 supply additional air into the secondary and whatever additional combustion zones may be provided with the addition of further conduits, which are positioned further along the flame path. For transferring heat away from the combustion zones heat extraction pipes 46, which may carry circulating water, are located in each of the combustion zones provided.

As mentioned previously, implementation of the methods as above described cause the following to take place:

(1) initial enhancement of rate of heat release (ROHR) of the combustible products during the early phase or entry phase of the combustible charge in the pre-reactions zone of combustion just before the combustion zone proper by means of each of the following, if all the methods are implemented:
   - radiation input or temperature feedback into the pre-reactions zone,
   - added heat to the pre-reactions zone because of the increased flow rate of recirculated water vapor and combusted gases including inert gases,
   - reduced primary air in the pre-reactions zone requiring less heat to elevate fuel temperature to self igniting conditions during staged combustion in which air supply is distributed to the additional zones.

(2) impediment of ROHR of the combustion process after prereactions of the combustible products has taken place by means of each of the following, if all the methods are implemented:
   - radiation output from the combustion zone,
   - thermal inertia of the temperature controlled, increased flow rate of exhausted gases fed back into the combustible products causing heat absorption during combustion,
   - controlled heat extraction at the additional combustion zones.

It should be understood that the position of the heat extraction pipes 46 are a matter of engineering design and that they may be located wherever it is desirable to extract heat from the various combustion zones without departing from the principles of the invention. Of course, even without pipes 46, the radiation alone of the radiating surfaces enveloping the combustion zones extracts heat from each zone.

It is understood that the shield may be made of thin sheet metal, of course of heat and corrosion proof quality, or may comprise ceramic components.

It can be provided with holes or made partially or entirely of a fine mesh kind of material.

DESCRIPTION OF THE PREFERRED EMBODIMENTS

Figure 5A:
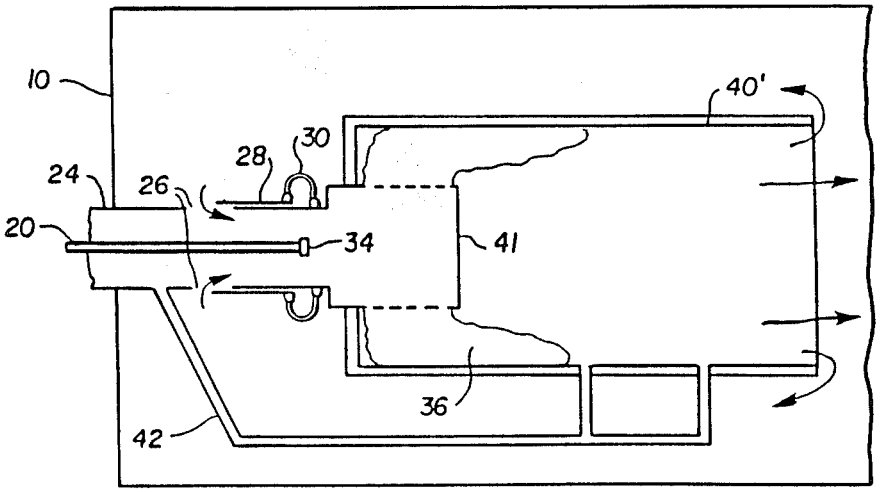
FIG. 5*a* is a schematic illustration of a further embodiment of the shield structure shown in FIG. 5.
Figure 7:
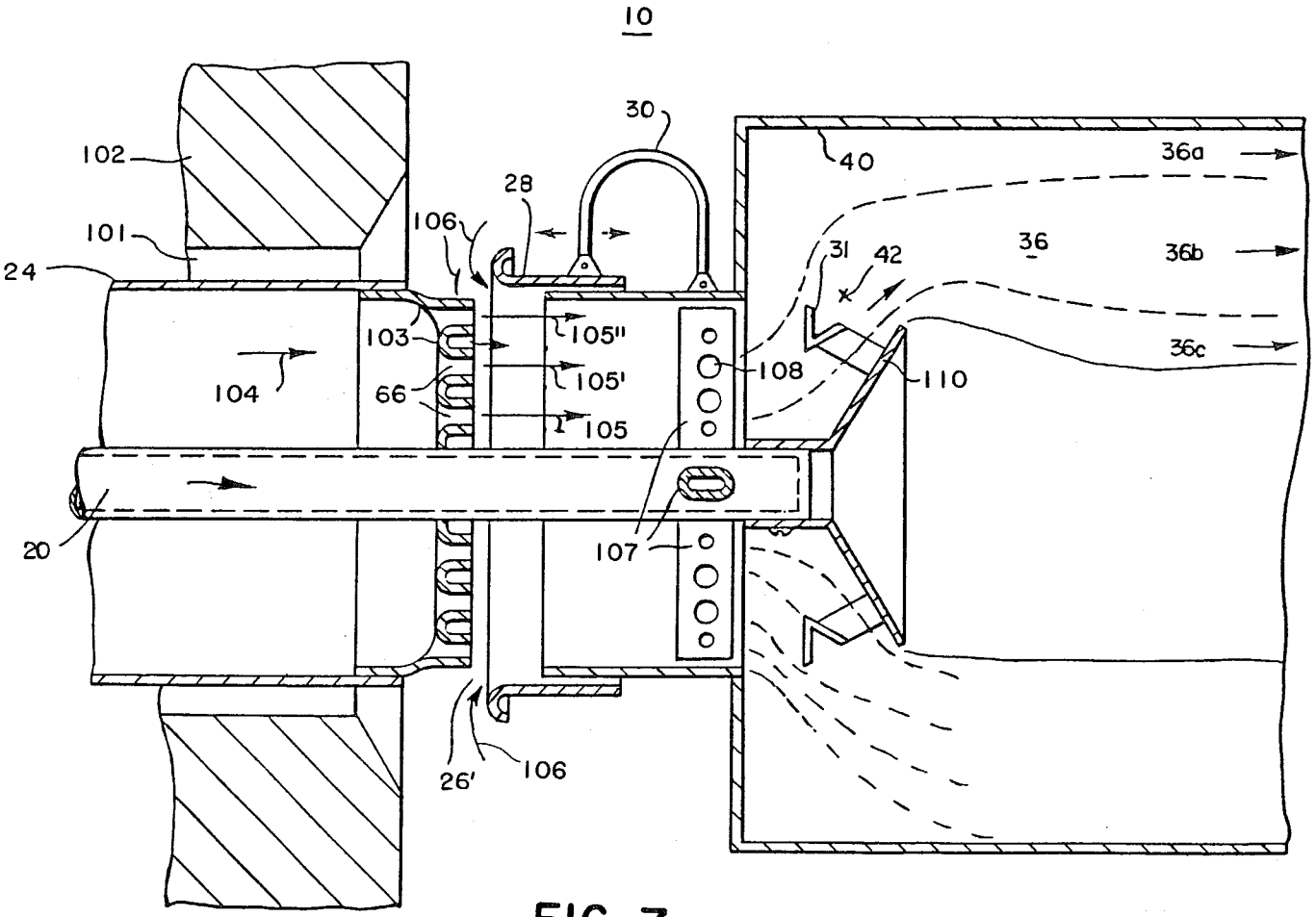
FIG. 7 is a schematic cross sectional view of a burner employing the principles of the invention.

Referring now to FIG. 7 which is a modification of the device shown in FIGS. 4, 5 and 5*a*, wherein like elements have corresponding reference characters there is shown a burner device comprising an air duct 24, which is arranged to conduct air from a blower, such as 18, into the furnace 10 of a basically conventional design, not shown. The air duct 24 penetrates through an installation burner wall having an opening 101, as shown in a wall section 102 of the furnace, which wall section is preferably contained in a door-like member of the furnaces as is well-known. An accordingly punched and formed disk-like member 103 subdivides the airflow 104 of lower speed into a multitude of airflows 105, 105', 105'', emanating from orifices 66, with correspondingly higher flowspeed, as shown by the different length of the related arrows before and after member 103. The thus established speed in the now shaped plurality of air-flows, which may be considered as air jets creates a predeterminable amount of zones with related pressures which allow for trapping and hence recirculating flue gas between and into the air charge through opening 26' as shown schematically by arrows 106. In this figure, and only by way of an example of a means to furnish a control there is shown a temperature responsive bimetallic member 30 such as shown in FIGS. 4, 5 and 5*a*, which is arranged to open or close a slidably arranged member 28, so as to control the opening area 26' of the flow section, to thereby control the flow rate of flue gas recirculation. It is obvious, that many other means may be utilized to create airjets to accomplish the same task and to control in a predetermined manner the flow rate of FGR (flue gas recirculation), preferably in relation to the flame or flue gas temperature, as set forth above.

Fuel introduction is realized in this example by a pipe 20, which conducts a preferably previously metered flowrate of gas, city or natural gas for example, towards a gas distributing member 107, here schematically shown as a member comprising radially arranged hollow distribution pipes, having orifices 108 of predetermined flow rates and disposed in different zones, so as to permit establishment of desired air to fuel ratios within the charge to be burnt. Downstream of this arrangement, preferably a flame holder 31 is arranged and supported by a flame guide 110, which conducts the charge towards guide members 40 enveloping at least in part the flame 36, which in this figure for example, contains the distinct zones of predetermined air/fuel ratios 36*a*, 36*b*, and 36*c*. The whole device is shown as coaxially symmetric, except that in the lower half, quite different flow rates of FGR and fuels are shown to be possible to be realized within the same burner.

It now becomes apparent that the apparatus according to the devices set forth herein are extremely simple in relation to its improved combustion control and especially, once calibrated and designed, it will maintain within close limits the once established proportions and laws of defined charge composition, even at wide load changes of a load modulated burner.

Figure 8:
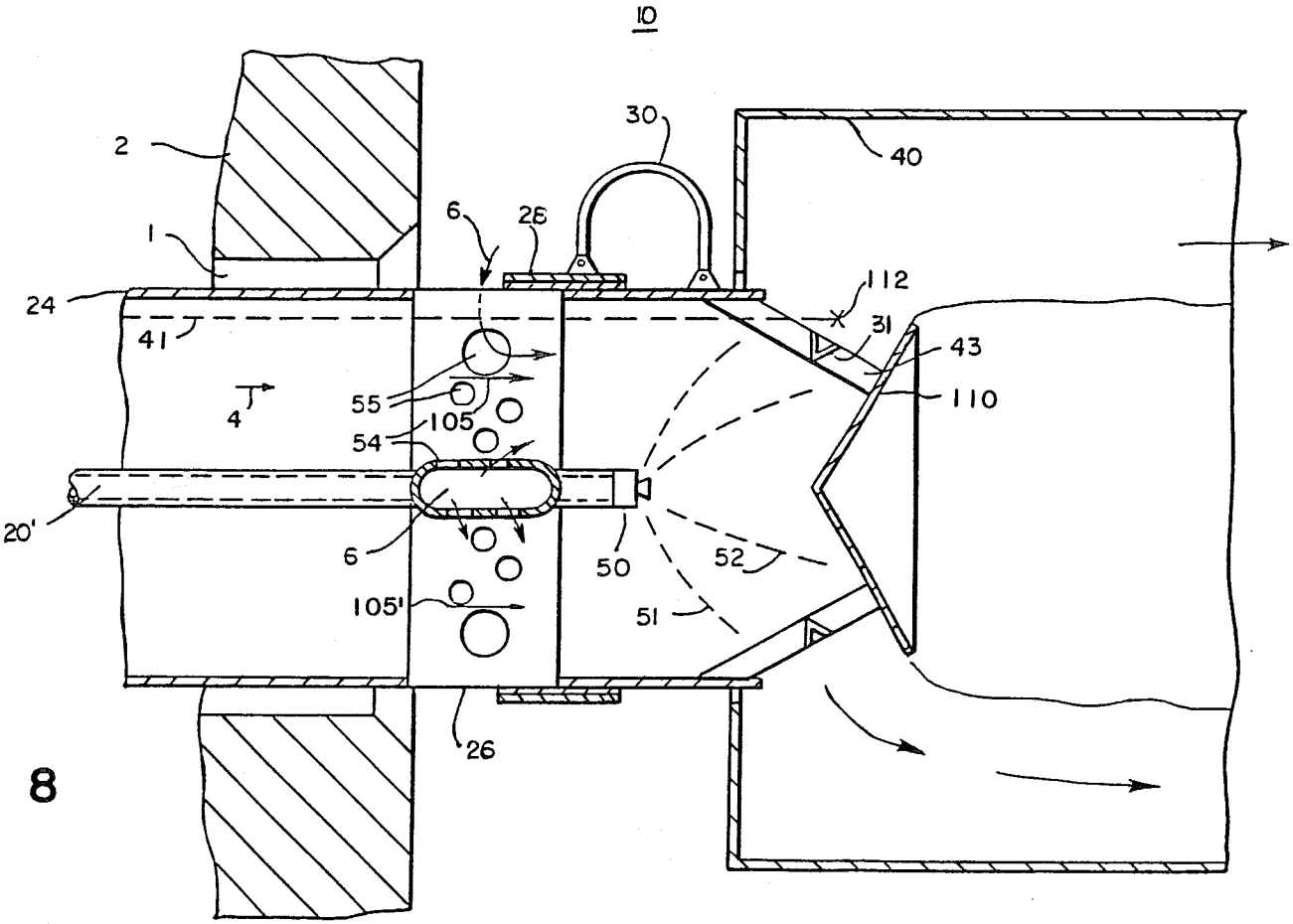
FIG. 8 is also a schematic cross sectional view of a different arrangement also performing the principles of the invention.

In FIG. 8 there is shown another embodiment of a burner which is also shown schematically but functionally in similar manner to that shown in FIG. 7 and heretofore described. Similar parts in each view which have the same function are provided with identical numerals. In FIG. 7 the structure differs from FIG. 6 in that a plurality of hollow members 54 subdivide the airflow 104 into zones 105, 105', of increased velocity. Predetermined openings 55 are disposed in these members 54, so as to allow for flue gas recirculation in predetermined amounts into different zones of the airflow. The flue gas flow 106 enters radially into these members 54, the flowrate being controllable by the slidably arranged member 28, as already described in connection with the above described devices.

Zone fuel supply, here of liquid fuel is accomplished by injection nozzle 50, providing for instance a series of fuel sprays circumferentially spaced and following two distinct spray angles. Ignition is realized by an electrode gap, located generally at point 112, the electric current supply arriving via conductors 41, as known per se. The flame holder 31 as well as the flame guide 110 are correlated by supporting members 43 which may be arranged so as to simultaneously induce a vortex flow component into the charge flow of the burnable or burning charge.

It is to be understood, that the number of, for instance radially arranged hollow arms 43 which serve to subdivide the airflow into zones and simultaneously conduct media as flue gas or natural gas etc., are only shown by way of example and a greater or lesser number of hollow arms can be utilized as desired.

Figure 9:
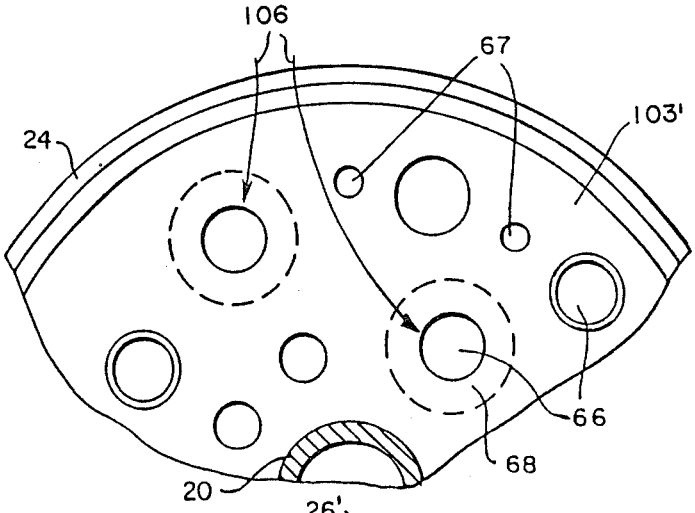
FIG. 9 shows a partial schematic, in front view of a part of a modification of an exemplary means for zoning an airstream shown in FIG. 1.

In FIG. 9 a part of a disk-like means 103' comparable to the means 103 shown in FIG. 7, is shown schematically in front view. This disk-like means comprises orifices 66 through which the airstream 104 of FIG. 7 is divided into a multitude of airstreams of higher velocity, creating around themselves individual zones 68 of lower pressure as known in injector pump devices. Flue gas is sucked in to these zones 68 as shown by arrows 106. Electrodes for igniting purposes may be conducted through openings 67. A fuel supply pipe 20 is shown near the center axis, it being understood, that through each orifice 66 air flows with essentially the same velocity, therefore generating around each of these individual and hence zoned airflows a suction zone 68.

Figure 10:
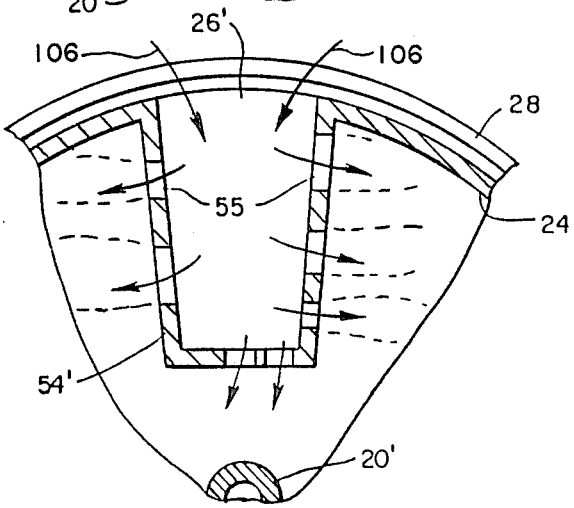
FIG. 10 shows a partial schematic, in front view of a part of still another modification of an exemplary means different from the modification shown in FIG. 3.

FIG. 10 shows schematically air flow zoning means 54', in part of airduct 24 in front view. Comparable to the means 54 in FIG. 8, the air flow in conduit 24 is obliged to flow around the structure 54' thereby increasing its speed and generating zones of lower pressure outside the lateral wall of structure 54'. This structure being simultaneously a guide means to guide flue gas to flow from outside conduit 24 along a path designated by arrows 6 into these zones of lower pressure passing a main opening 26' controllable by control means 28. The calibration of flue gas flow rate into said airstream being determined by the selectable size of orifices 55 arranged in structure 54'. A fuel pipe 20' is also shown arranged toward the center of the air conduit as exampled in FIG. 9.

Figure 11:
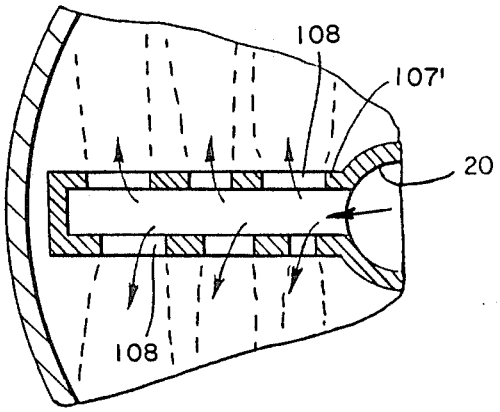
FIG. 11 shows a partial schematic, in front view of a modification of an exemplary means for zoned gaseous fuel introduction in an airstream as shown in FIG. 1.

In FIG. 11 a partial schematic front sectional view of a part of a fuel charging means for zoned fuel introduction, comparable to means 107 shown in FIG. 7 is shown. In this case, gaseous fuel is introduced via fuel pipe 20 into hollow structure 7 comprising selectively calibrated orifices 108 through which fuel is introduced into oxygen carrying gas in a spaced manner at defined flow rates so as to generate desired zones of charges containing defined ratios of air to fuel.

Figure 12:
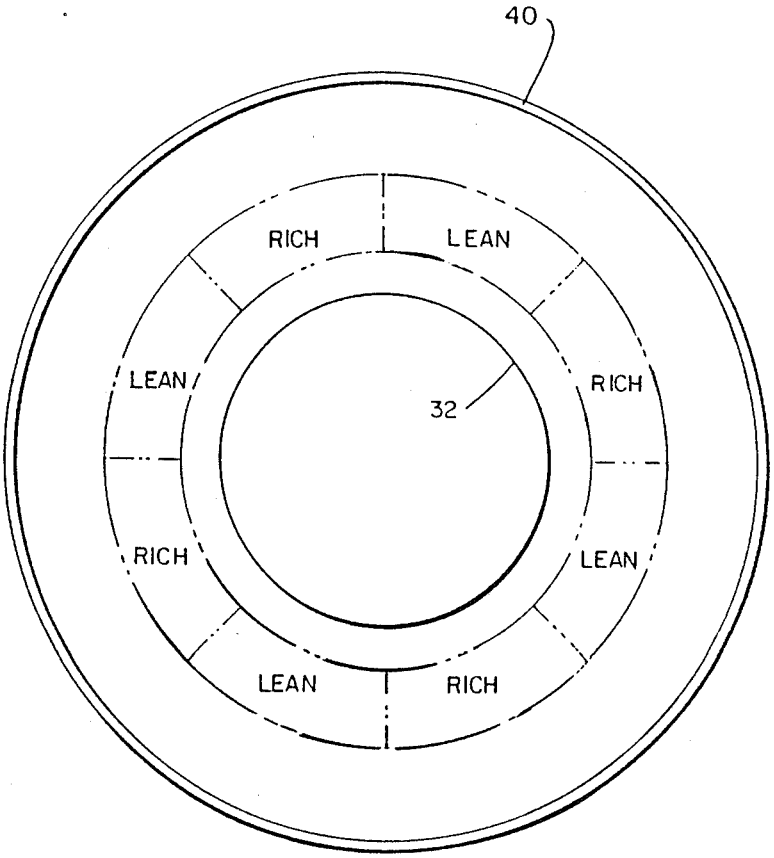
FIG. 12 generally shows, in front elevation and schematically, an exemplary pattern of various change compositions destinated to undergo a combustion process after their ignition.

In FIG. 12 an exemplary pattern of desired charge compositions in desired zones of a charge to be burnt is shown schematically in a cross sectional view. Here the charge or flame is externally guided by guide means 40 comparable to the longitudinal section of FIG. 7. It is apparent, that not only radial zoning but also circumferential zoning of charge composition is achieved as desired. So for example, imbedded between an outer and an inner zone of, for example, essentially stoichiometric air fuel composition, containing a higher dilution by flue gas, a multitude of rich and lean charges alternate, all of which are arranged to contain less flue gas amounts than the surrounding layers.

In the modifications as exemplified by FIGS. 7–11, the exhaust gases are directed back through the air fuel device and controlled in accordance with temperature the hotter the temperature the greater the opening until full open has been established.

The foregoing relates to a preferred exemplary embodiment of the invention, it being understood that other variants and embodiments thereof are possible within the spirit and scope of the invention, the later being defined by the appended claims.

I claim:

1. A method for controlling the rate of heat release in a flame of combustible products undergoing a combustion process comprising generating an air flow in an air conduit extending into a furnace;

directing a supply of fuel into a nozzle means in said air conduit for feeding combustible products into said air conduit;

recirculating products of combustion generated in said furnace back through at least one orifice in said air conduit located within said furnace;

variably controlling the opening size of said orifice to control a ratio of the mass flow of the recirculated products of combustion to the mass flow of the air flow, increasing the rate of flow of said recirculated products of combustion during warm-up of said furnace to an operating temperature, and increasing said ratio in a predetermined response to a value essentially dependent on the temperature generated by the heat released.

2. A method according to claim 1, wherein said method of controlling said ratio includes increasing said ratio during the said warm up phase in dependence of the time.

3. A method according to claim 1, wherein said ratio is controlled by variable throttling of the combined stream of air and recirculated combustion products downstream of said at least one orifice.

4. An apparatus for controlling the rate of heat release in a flame of combustible products undergoing a combustion process in a furnace comprising:

heat exchange means and combustor means, and means further having a fuel supply control;

air blower means for generating an air flow in an air conduit, said air conduit extending into said furnace;

nozzle means extending from said fuel supply control for feeding combustible products into said air conduit;

said conduit including at least one orifice arranged inside said furnace and adapted to variably recirculate products of combustion from said furnace into said airflow, and control means operated in relation to temperature in said furnace which variably controls the flow of recirculated products of combustion through said at least one orifice in said conduit which controls the ratio of the mass flow of said recirculated products of combustion to the mass flow of said air.

5. An apparatus as claimed in claim 4, wherein said control means are adapted to control the size of said at least one orifice.

6. An apparatus as claimed in claim 4, wherein said at least one orifice is arranged upstream of said fuel nozzle.

7. An apparatus as claimed in claim 5, wherein said at least one orifice is substantially obstructed during start-up by said means controlling the size of said at least one orifice.

8. An apparatus as claimed in claim 4, wherein said flame is guided by guide means, enveloping at least an initial stage of said flame.

9. An apparatus as claimed in claim 4, wherein said flame is guided substantially over its entire length by guide means which simultaneously are heat radiating to thereby control the rate of heat release.

10. An apparatus as claimed in claim 4, wherein the control means for said orifices includes bimetallic means.

11. An apparatus as claimed in claim 4, wherein said flame is guided by guide means including shield means shaped to cause said flame upon impingement thereon to swirl.

12. An apparatus according to claim 4, having means for forming a primary and a second combustion zone connected to said conduit, and air passage means connected upstream of said opening to said air conduit to deviate a part of said airflow towards said second combustion zone means while bypassing said primary combustion zone means.

13. An apparatus as claimed in claim 11, wherein said shield means extends axially and envelopes said flame and further includes an internal baffle for directing said flame radially against the surface of the axially extending shield.

14. An apparatus as claimed in claim 4, wherein said air conduit includes injector means for increasing the airspeed and decreasing air pressure, said recirculating combustion products are drawn from said airflow having said lowered pressure.

15. An apparatus as claimed in claim 4, wherein said air conduit includes flow guide means subdividing said air into partial zones of higher airspeed and lower air pressure into which said recirculating combustion products are introduced.

16. An apparatus as claimed in claim 11, wherein said guide means includes means for subdividing said airflow into partial zones of higher airspeed and lower pressure into which said flue gas is introduced, and said means for subdividing said airflow is arranged to introduce predetermined amounts of flue gas into predetermined zones of said partial zones of said airflow.

* * * * *